US005615592A

United States Patent [19]

Tippmann

[11] Patent Number: 5,615,592

[45] Date of Patent: Apr. 1, 1997

[54] LEATHER CUTTING APPARATUS

[76] Inventor: Dennis J. Tippmann, 12708 Parent Rd., New Haven, Ind. 46774

[21] Appl. No.: 382,203

[22] Filed: Feb. 1, 1995

[51] Int. Cl.[6] ..... B26D 5/12; B26F 1/40

[52] U.S. Cl. ..... 83/529; 83/531; 83/541; 83/639.3; 83/DIG. 1

[58] Field of Search ..... 83/531, 532, 533, 83/539, 540, 541, 639.1, 639.3, 652, 529, DIG. 1; 100/231; 69/2, 47, 48

[56] References Cited

U.S. PATENT DOCUMENTS

| | | | |
|---|---|---|---|
| 300,725 | 6/1884 | Newell | 100/231 X |
| 2,760,569 | 8/1956 | Suerken | 83/541 |
| 3,613,764 | 10/1971 | Guenard | 100/231 X |
| 3,822,627 | 7/1974 | Bianchi | 83/639.1 X |
| 3,905,265 | 9/1975 | Peterson et al. | 83/541 X |
| 3,933,065 | 1/1976 | Janu et al. | 83/639.1 X |
| 3,987,696 | 10/1976 | Haas et al. | 83/DIG. 1 X |
| 4,001,645 | 1/1977 | Haas et al. | 83/541 X |
| 4,277,996 | 7/1981 | Spengler | 83/639.3 X |
| 4,363,253 | 12/1982 | Cantella | 83/DIG. 1 X |
| 4,420,958 | 12/1983 | Schulz et al. | 72/21 |
| 5,299,482 | 4/1994 | Schmitt | 83/639.3 X |

FOREIGN PATENT DOCUMENTS

| | | | |
|---|---|---|---|
| 0200870 | 6/1983 | Germany | 100/231 |

*Primary Examiner*—Eugenia Jones
*Attorney, Agent, or Firm*—Joseph J. Baker, Esquire

[57] ABSTRACT

An apparatus is disclosed for bringing a cutting die into engagement with a workpiece such as leather, the apparatus includes first and second plates secured to C-shaped frame members and a platen for supporting the workpiece that is movable relative to the second plate upon inflation of a bladder secured to the periphery of the second plate upon actuation of first and second valves connected between a source of pressurized air and the bladder.

1 Claim, 3 Drawing Sheets

LEATHER CUTTING APPARATUS

BACKGROUND OF THE INVENTION

The invention relates to cutting devices and more specifically to a compact pneumatically operated device for forcing a cutting die into engagement with a workpiece of flexible material to effect cutting thereof.

Apparatus for cutting three-dimensionally shaped workpieces employing one or more air inflatable bladders to move a workpiece into engagement with a cutting or shaping die are known as disclosed, for example, in U.S. Pat. Nos. 4,420,958 and 5,299,482. These devices and others, of which applicant is aware, are fairly massive and employ air inflatable bladders of the continuous or balloon-type. Such bladders substantially increase the overall size of the device and are susceptible to breakdown when repeatedly flexed in the side areas where the upper and lower sections thereof meet. Applicant's device in contrast employs a single sheet of air impervious material which is secured in airtight engagement around the peripheral edge thereof to the base. The base forces a platen positioned thereon toward a fixed, spaced apart plate upon the introduction of pressurized air beneath the sheet material.

In order to contain the great pressures generated yet keep the device of a size suitable for table top use, applicant employs C-shaped frame members for mounting the various support plates which results in an unobstructed area that enables the sheet material workpiece to be moved horizontally in a straight line direction or rotated beneath the cutting die.

In addition, because great pressures can be generated between the plates by expansion of the sheet material upon introduction of pressurized air, serious injury to a person's extremities can be caused. Thus, applicant employs controls located on the top of the device having spaced-apart valve control knobs, each of which must be depressed by a hand of the user thereby insuring the hands or fingers thereof cannot be between the plates.

It is therefore the primary object of the present invention to provide a superior, user safe pneumatically operative apparatus for cutting leather material and the like.

It is another object to provide a cutting device of the subject type which employs a bladder consisting of a single sheet of air impervious material to ensure long operating life.

It is yet another object to provide a cutting device of the subject type which is very compact and versatile due to its use of C-shaped frame members.

It is a further object to provide a cutting device of the subject type having controls located to ensure user safe operation.

It is still further object to provide a cutting device of the subject type that is relatively inexpensive to manufacture due to its few moving parts yet is economical to use and maintain and is highly reliable in its operation.

These and other objects and purposes of this invention will be understood by those acquainted with the design and construction of cutting devices upon reading the following specification and accompanying drawings.

DETAILED DESCRIPTION OF THE PREFERRED EMBODIMENTS

Figure 1:
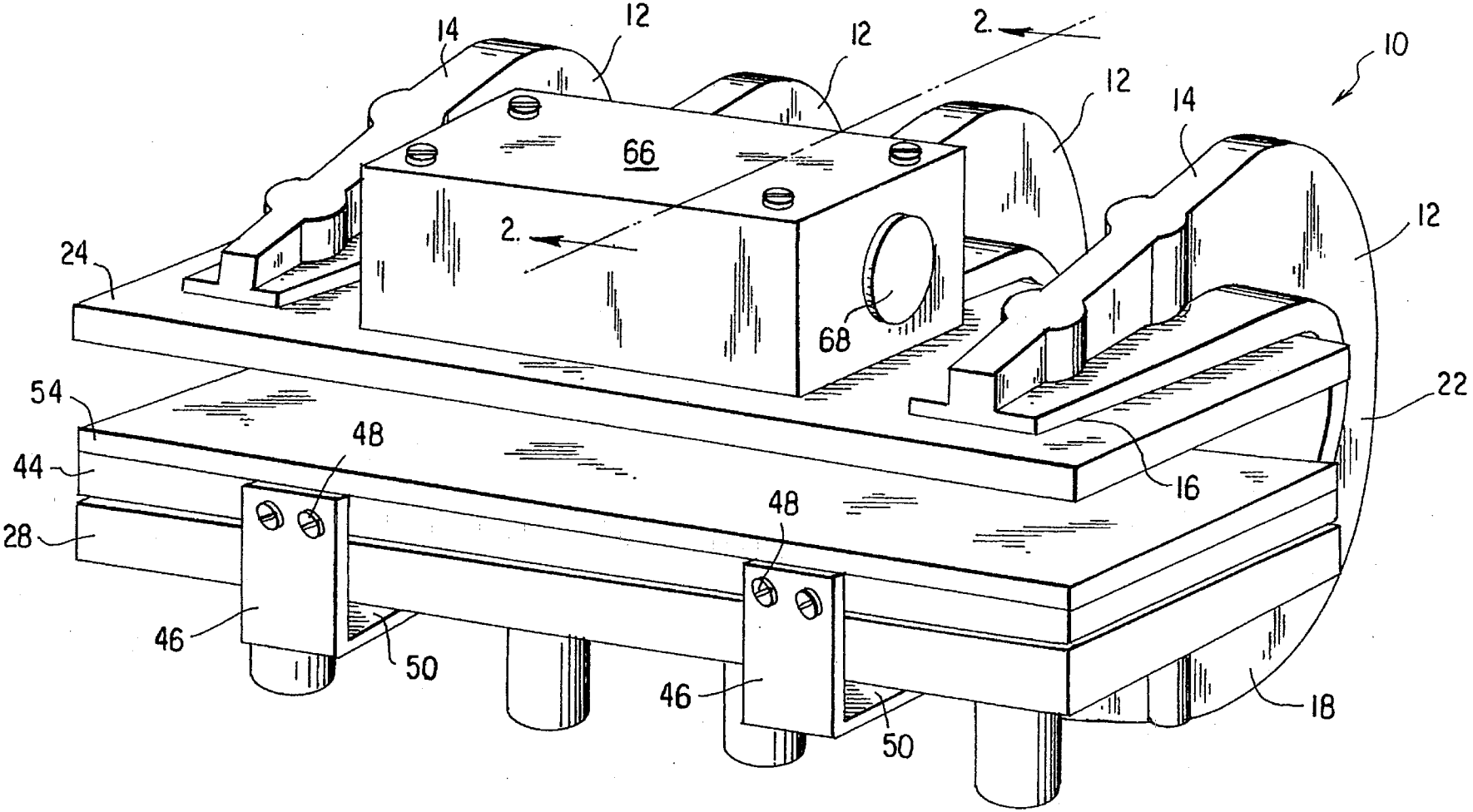
FIG. 1 is a perspective view of the leather cutting device of the present invention.
Figure 2:
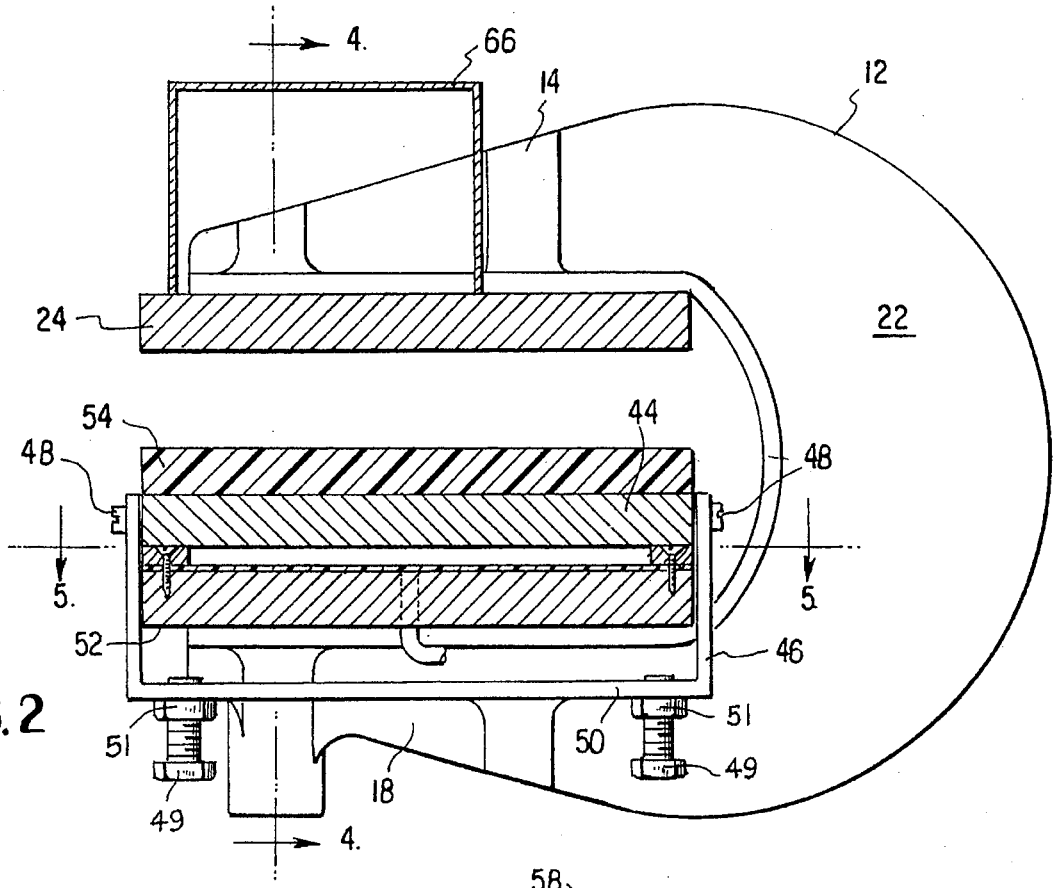
FIG. 2 is a cross-sectional view taken along the lines 2—2 of FIG. 1 when the device is in its open position.

Referring now to the drawings where like characters of reference indicate similar elements in each of the several views, 10 refers to the leather cutting apparatus of the present invention. The apparatus 10 has a plurality of C-shaped frame members 12 positioned in spaced-apart relationship. Each frame member 12 has an upper arm 14 having an upper mounting surface 16 integrally formed therewith and a lower arm 18 having a lower mounting surface 20 also integrally formed therewith. An intermediate section 22 connects the arms 14, 18.

Figure 3:
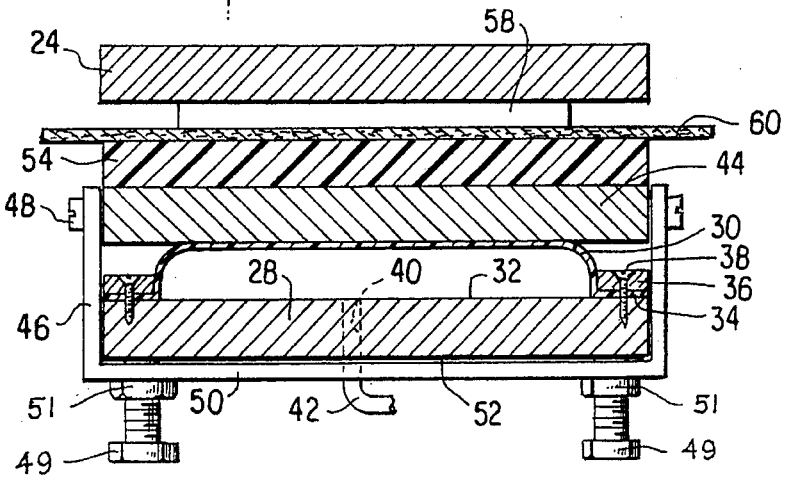
FIG. 3 shows the device of FIG. 2 in its closed position.
Figure 5:
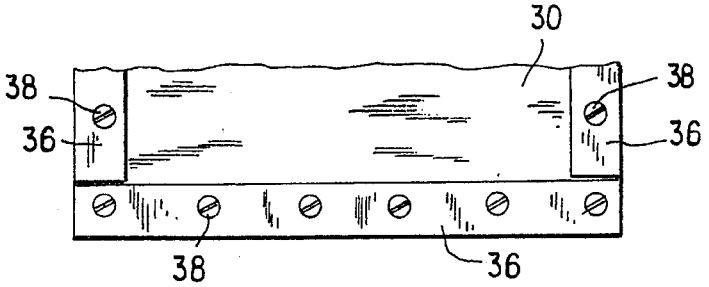
FIG. 5 is a partial plan view taken along the lines 5—5 of FIG. 2.

A first pressure plate 24 is secured to the upper mounting surface 16 by means of screws 26 and a second pressure plate 28 is secured to the lower mounting surface 20 also by means of screws 26. An air impervious sheet of expandable plastic-like bladder material 30 extends across the upper facing surface 32 of the second pressure plate 28. The peripheral edge portion 34 of the sheet material 30 is sealed in airtight engagement with the upper facing surface 32 by means of a metal band 36. The metal band 36 forces the edge portion 34 of sheet material 30 into sealing engagement with the upper facing surface 32 by means of closely spaced-apart screws 38. The second pressure plate 28 has an aperture 40 therethrough to which an inlet pipe 42 is connected to permit the passage of pressurized air from a source 62 to the area beneath the sheet material bladder 30 to thereby expand or inflate it to the position shown in FIG. 3.

A movable intermediate plate or platen 44 substantially the same size as the second pressure plate 28 is positioned on the bladder material 30 and is held loosely in position by means of spaced-apart U-shaped brackets 46 extending beneath the second pressure plate 28 and secured at the ends thereof to the second pressure plate 28 by means of screws 48. Adjustable stop bolts 49 are rotatably mounted in spaced-apart relationship in central portion 50 of the U-shaped bracket 46. Locknuts 51 are mounted on the adjustable stop bolts 49 for engagement with the central portion 50 to maintain the stop bolts 49 in their desired position. As can be seen, as the bladder material 30 expands under the influence of pressurized air, the platen 44 is caused to move toward first pressure plate 24 until the ends of stop bolts 49 engage the under surface 52 of the second pressure plate 28 thereby stopping its travel.

A cover plate 54 of plastic-like material can be secured to the upper surface 56 of the platen 44 by means of an adhesive to reduce dulling of the cutting edge of a cutting die 58 positioned beneath the first pressure plate 24 and a workpiece 60 such as leather or other flexible sheet material. As the cutting edge of die 58 passes through the sheet material severing same, it comes to rest adjacent the cover plate 54. The stop bolts 49 are used to adjust for the height of cutting die 58 as well as for wear of cover plate 54.

Figure 4:
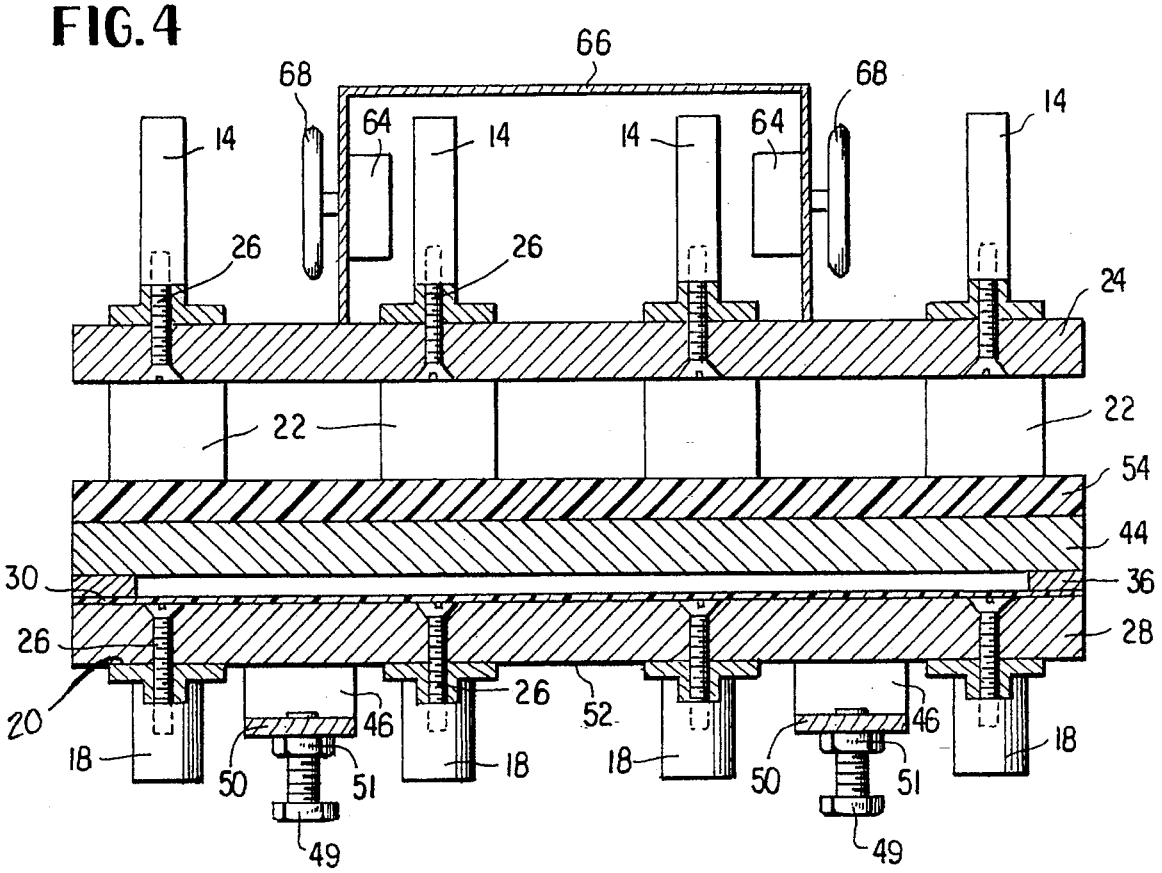
FIG. 4 is a cross-sectional view taken along the lines 4—4 of FIG. 2.
Figure 6:
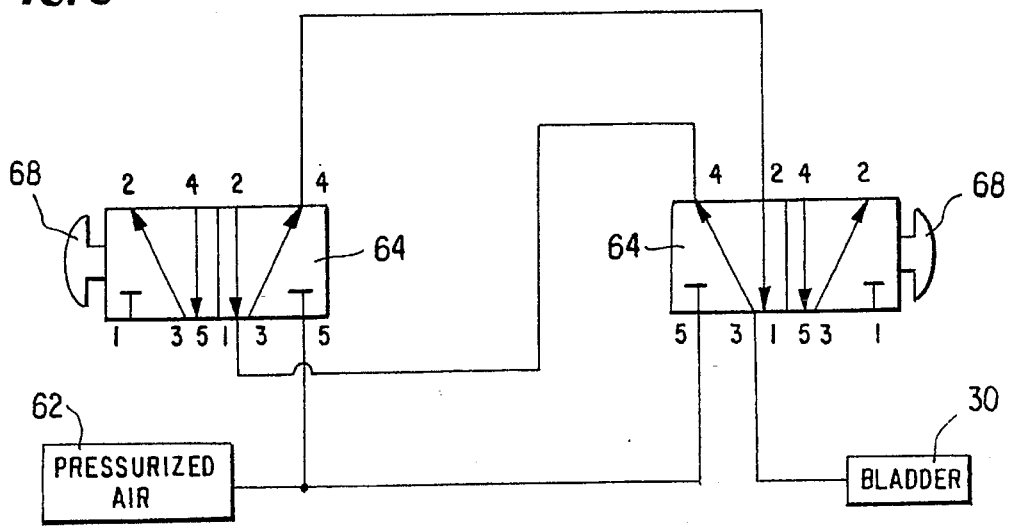
FIG. 6 is a schematic representation o the fluid circuit in the present invention.

Referring now to FIG. 4, in order to control the flow of pressurized air from a supply 62 to inflate the bladder 30, a pair of identical valves 64 are mounted in spaced-apart relationship on housing 66. The valves 64 have buttons 68 to control actuation thereof by means of the hands of the operator of the apparatus. As can be seen from the pressurized air control circuit shown in FIG. 6, if either button 68 is pushed individually, it will allow air to exhaust at full volume until released and no air will go to the bladder 30. When both palm buttons are pushed simultaneously, air from the supply 62 is delivered to the bladder 30. If either button or both buttons 68 are released, the air supply 62 is stopped and venting of the bladder 30 is initiated. The platen 44 immediately stops its upward motion and returns to its normal position. As can be seen, the two buttons 68 are mounted approximately ten inches apart in opposed relationship making it mandatory to use both hands on the buttons at all times to operate the cutting apparatus.

Applicant has thus described in detail his novel pneumatically operated cutting apparatus.

What is claimed is:

1. An apparatus for cutting a three-dimensionally shaped workpiece comprising:

a) a plurality of spaced-apart C-shaped frame members, each of said frame members having an upper and an oppositely disposed lower mounting surface, b) a first plate means secured to said upper mounting surface of each frame member, c) a second plate means secured to said lower mounting surface of each frame member, d) inflatable bladder means comprising a single sheet of air impervious material secured in airtight engagement around the peripheral edge thereof to said second plate means, e) platen means positioned on said bladder means for supporting said workpiece and movable relative to said second plate means upon inflation of said bladder means, f) cutting means positioned between said first plate means and said platen means and above said workpiece to thereby cut said workpiece as said platen means is moved toward said first plate means upon inflation of said bladder means, g) U-shaped bracket means secured to said platen means and extending beneath said second plate means, said bracket means having adjustable means to limit the vertical travel of said platen means upon inflation of said bladder means, and h) first and second valve means connected between a source of pressurized air and said bladder means for controlling inflation of said bladder means upon actuation of both said first and second valve means.

* * * * *